US006444385B2

(12) United States Patent
Azuma et al.

(10) Patent No.: US 6,444,385 B2
(45) Date of Patent: Sep. 3, 2002

(54) ELECTROPHOTOSENSITIVE MATERIAL AND METHOD OF PRODUCING THE SAME

(75) Inventors: Jun Azuma; Mitsuo Ihara; Maki Uchida; Daisuke Kuboshima; Yukikatsu Imanaka, all of Osaka; Hiromi Nakatsu, Amagasaki; Teruyo Taguchi, Osaka, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/808,117

(22) Filed: Mar. 15, 2001

(30) Foreign Application Priority Data

Apr. 10, 2000 (JP) ..... 2000-108498

(51) Int. Cl.[7] ..... G03G 5/06
(52) U.S. Cl. ..... 430/59.4; 430/129
(58) Field of Search ..... 430/56, 129, 133, 430/59.7

(56) References Cited

U.S. PATENT DOCUMENTS 4,615,965 A 10/1986 Matsumoto et al. ..... 430/127
5,128,229 A * 7/1992 Katsukawa et al. ..... 430/96
5,389,419 A * 2/1995 Maeda et al. ..... 430/270.19

FOREIGN PATENT DOCUMENTS

EP 0 420 580 A2 4/1991
EP 0 615 164 A2 9/1994
JP 2 201450 8/1990
JP 3-33859 2/1991
JP 6-337525 12/1994
JP 8-160643 6/1996

OTHER PUBLICATIONS

European Search Report issued for corresponding European Appln. No. EP 01 30 3318 dated Mar. 7, 2002.

* cited by examiner

*Primary Examiner*—John Goodrow
(74) *Attorney, Agent, or Firm*—Smith, Gambrell & Russell

(57) ABSTRACT

The present invention relates to an electrophotosensitive material wherein a layer containing a binder resin and a pigment among a photosensitive layer is formed by applying and drying a coating solution prepared by dispersing the binder resin and the pigment in a dispersion medium containing alcohol represented by the formula (1):

(1)

wherein $R^1$, $R^2$ and $R^3$ are the same or different and represent a hydrogen atom or an alkyl group; the electrophotosensitive material is free from lowering of the sensitivity due to formation of agglomerates of the pigment and is superior in sensitivity characteristics.

11 Claims, 3 Drawing Sheets

ELECTROPHOTOSENSITIVE MATERIAL AND METHOD OF PRODUCING THE SAME

BACKGROUND OF THE INVENTION

Present invention relates to an electrophotosensitive material used in image forming apparatuses such as laser beam printer, electrostatic copying machine, plain paper facsimile, and combined machine with functions of them. The present invention also relates to a method of producing the electrophotosensitive material.

Recently, an organic photosensitive material comprising an electric charge generating material capable of generating electric charges by irradiation with light, an electric charge transferring material capable of transferring generated electric charges, and a binder resin has widely been used as the electrophotosensitive material. The organic photosensitive material is easily produced as compared with a conventional inorganic photosensitive material using an inorganic semiconductor material. Also the organic photosensitive material has advantages such as wide range of choice of materials such as electric charge generating material, electric charge transferring material and binder resin, and high functional design freedom.

The organic photosensitive material includes:

a photosensitive material comprising a single-layer type photosensitive layer wherein an electric charge generating material and an electric charge transferring material are dispersed in the same single layer made of a binder resin, and a photosensitive material comprising a multi-layer type photosensitive layer wherein an electric charge generating layer containing an electric charge generating material and an electric charge transferring layer containing an electric charge transferring material are mutually laminated. The single-layer type photosensitive layer is formed by applying a coating solution, which is prepared by dispersing the respective components constituting the layer in a dispersion medium (organic solvent is exclusively used), on a conductive substrate, followed by drying-up. The multi-layer type photosensitive layer is formed by applying a coating solution for electric charge generating layer and a coating solution for electric charge transferring layer on a conductive substrate in this order or reverse order, followed by drying-up.

The electric charge generating material used in the photosensitive material includes various pigments according to the wavelength range at which the photosensitive material has the sensitivity. As the pigment for photosensitive material, which is sensitive to infrared to near infrared light such as semiconductor laser, infrared LED or the like, a phthalocyanine pigment is used. The phthalocyanine pigment includes metal-free phthalocyanine, titanyl phthalocyanine and the like, which differ in chemical structure.

The dispersibility of the pigment in the coating solution exerts a large influence on sensitivity characteristics of the photosensitive material. Therefore, various studies about a dispersion medium, which is capable of satisfactorily dispersing a pigment and a binder resin therein and also exhibits good stability after dispersion, have been made.

As the dispersion medium, a halogenated organic solvent has widely been used as a medium having excellent dispersibility of the pigment. However, use of the halogenated organic solvent tends to be avoided because of consideration to rise in environmental consciousness. Therefore, it has been required to secure the same dispersibility as that of the halogenated dispersion medium using a non-halogen dispersion medium.

As the non-halogen dispersion medium, for example, cyclohexanone, acetic esters, propanol, cellosolves and tetrahydrofuran are generally used. Also there is a report that alcohol is preferably used as the dispersion medium in case of α-type titanyl phthalocyanine (Japanese Laid-open Patent Publication JP 08-160643 A).

Japanese Laid-open Patent Publication JP 03-033859 A suggests use of at least one selected from the group consisting of branched ester, branched alcohol and branched ketone as the dispersion medium capable of satisfactorily dispersing Y-type titanyl phthalocyanine, and polyvinyl butyral and/or silicone resin.

Japanese Laid-open Patent Publication JP 06-337525 A suggests use of an organic solvent having a hydroxyl group and an ether group in a molecule (so-called cellosolves) as the dispersion medium capable of satisfactorily dispersing a phthalocyanine pigment such as α-type titanyl phthalocyanine, and polyvinyl butyral.

The present inventors have studied and found that a conventional coating solution using a phthalocyanine pigment in combination with a binder resin and the dispersion medium described in the respective prior arts described above has the following problems.

(i) It tends to cause precipitation or separation of a pigment immediately after preparation of the coating solution because the dispersibility of the pigment is still insufficient.

(ii) It is liable to cause precipitation or separation of a pigment during the storage of the coating solution for a long period of time because the dispersion stability of the pigment is insufficient, even if the dispersibility of the pigment is comparatively good.

(iii) Regarding an electrophotosensitive material comprising a layer containing a binder resin and a pigment (hereinafter, referred to as a "pigment dipersion layer"), which is formed by applying and drying the coating solution having the problem (i) or (ii), the sensitivity is drastically lowered. As used herein, the "pigment dispersion layer" includes a single-layer type photosensitive layer itself, and an electric charge generating layer among a multi-layer type photosensitive layer.

SUMMARY OF THE INVENTION

An object of the present invention is to provide a novel electrophotosensitive material which is free from lowering of the sensitivity and is superior in sensitivity characteristics.

Another object of the present invention is to provide a method of producing such an electrophotosensitive material.

The present inventors has studied intensively about the cause for lowering of the sensitivity of the photosensitive material as a result of formation of the pigment dispersion layer from the coating solution having the problem (i) or (ii) using a conventional dispersion medium, as described in (iii), and found the following fact.

The phthalocyanine pigment generally has strong agglomeration properties. Therefore, when the phthalocyanine pigment is used in combination with a conventional dispersion medium having poor dispersibility of the pigment, the pigment agglomerates to form agglomerates within a very short time until a pigment dispersion layer is formed by applying and drying the coating solution. Regarding the pigment dispersion layer thus formed, a large number of agglomerates of the pigment are formed in the layer. In such a pigment dispersion layer, the concentration of the pigment at the portion other than the agglomerates is drastically decreased as compared with the case where the pigment is uniformly dispersed in the layer. Therefore, the sensitivity at the portion is drastically lowered, thus lowering the sensitivity of the whole photosensitive material.

In some case, the degree of the lowering of the sensitivity at the portion other than the agglomerates is not large enough to impair the practicality because of less agglomeration of the pigment. In this case, however, there arises a new problem that image defects such as black spots and fogging are liable to be caused by lowering of charge at the agglomerate portion.

Therefore, the present inventors have studied about the cause for lowering of the dispersibility of the pigment and the dispersion stability of the coating solution in the coating solution using a conventional dispersion medium. As a result, they have found that the surface condition of particles of the pigment has a close relation with these characteristics.

In a dispersion medium, a binder resin is adsorbed on the surface of pigment particles and the pigment particles are stably dispersed in the dispersion medium by swelling of the binder resin with the dispersion medium. Therefore, when the amount of the resin adsorbed on the surface of the pigment particles becomes larger, the dispersibility of the pigment particles is improved and the dispersion stability of the coating solution is improved. On the other hand, when the amount of the resin adsorbed on the surface of the pigment particles becomes smaller, the dispersibility of the pigment particles is lowered and the dispersion stability of the coating solution is lowered.

It has hitherto been considered that a dispersion medium capable of satisfactorily dispersing α-type thitanyl phthalocyanine therein is preferably conventional alcohol. However, when polyvinyl acetal such as polyvinyl butyral is used as the binder resin in the combination of the both, neither good dispersibility nor good dispersion stability could not be obtained. It is considered that this cause is based on the mechanism described above.

Comparing the conventional alcohol with polyvinyl acetal, the alcohol has strong polarity and strong hydrogen bonding properties as compared with polyvinyl acetal. Therefore, when polyvinyl acetal is dissolved in the alcohol and α-type titanyl phthalocyanine is also dispersed, the alcohol is adsorbed on the surface of pigment particles (particles of α-type titanyl phthalocyanine) in the amount larger than that of polyvinyl acetal. As a result, since the number of polyvinyl acetal adsorbed onto the surface of pigment particles is reduced, the dispersibility of the pigment particles is lowered and the dispersion stability of the coating solution is lowered.

Considering the mechanism described above, it is assumed that, when the polarity and hydrogen bonding properties of the alcohol are weakened, the number of the binder resin such as polyvinyl acetal absorbed onto the pigment particles increases, thereby to improve the dispersibility of the pigment particles and to improve the dispersion stability of the coating solution. Therefore, the present inventors have studied about the fact that strong polarity and hydrogen bonding properties due to an alcoholic hydroxyl group are inhibited by introducing an electron attractive group such as —CO—O—, —O—, >N—, >C=O or the like into a molecule of the alcohol. As a result, they have found that, when using alcohol having a >C=O group in a molecule of the formula (1):

(1)

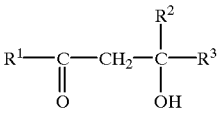

wherein $R^1$, $R^2$ and $R^3$ are the same or different and represent a hydrogen atom or an alkyl group, which pertains to alcohol in a broad sense but is not specifically disclosed in the prior art, and which has never been used in the electrophotosensitive material, the dispersibility of the pigment in the coating solution and the dispersion stability of the coating solution are improved, thereby making it possible to form a pigment dispersion layer having excellent dispersibility of the pigment.

Accordingly, the invention of claim 1 is directed to an electrophotosensitive material comprising a photosensitive layer having at least a layer containing a binder resin and a pigment (pigment dispersion layer), wherein the layer is formed by dispersing the binder resin and the pigment in a dispersion medium comprising at least alcohol represented by the formula (1):

(1)

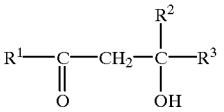

wherein $R^1$, $R^2$ and $R^3$ are the same or different and represent a hydrogen atom or an alkyl group, to prepare a coating solution, and applying and drying the coating solution.

The constitution of the electrophotosensitive material of claim 1 is preferably employed in case the pigment includes a phthalocyanine pigment having strong agglomeration properties.

Accordingly, the invention of claim 2 is directed to the electrophotosensitive material according to claim 1, wherein the pigment includes at least a phthalocyanine pigment.

The constitution of the electrophotosensitive material of claim 1 is also preferably employed in case the binder resin includes polyvinyl acetal which has weak polarity and hydrogen bonding properties as compared with conventional alcohol.

Accordingly, the invention of claim 3 is directed to the electrophotosensitive material according to claim 1, wherein the binder resin includes at least polyvinyl acetal.

Preferable alcohol of the formula (1) is diacetone alcohol represented by the formula (1—1).

(1-1)

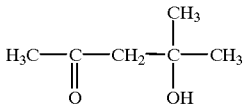

Accordingly, the invention of claim 4 is directed to the electrophotosensitive material according to claim 1, wherein the alcohol of the formula (1) is diacetone alcohol.

The invention of claim 5 is directed to the electrophotosensitive material according to claim 1, wherein the existence of agglomerates of the pigment is not found in a 0.25 mm square region in actual size of the pigment dispersion layer at any of plural positions.

In case the existence of at least one agglomerate of the pigment is found, the sensitivity is likely to be lowered drastically by the formation of the agglomerate of the pigment. On the other hand, the electrophotosensitive material, wherein the existence of any agglomerate of the pigment is not found in the pigment dispersion layer, is superior in sensitivity characteristics and does not cause defects such as black dots and fogging on the image.

The present inventors also have studied about the procedure for preparation of the coating solution so as to improve the dispersibility of the pigment and to improve the dispersion stability of the coating solution, using various dispersion mediums including the alcohol of the formula (1).

As a result, they have found that, a coating solution is prepared by dispersing a binder resin and a pigment in an arbitrary organic solvent, drying the dispersion to remove the organic solvent to obtain a powder in which the binder resin is adsorbed on the surface of pigment particles, and dispersing the powder in a dispersion medium, the dispersibility of the pigment and the dispersion stability of the coating solution are improved, thereby making it possible to form a pigment dispersion layer having excellent dispersibility of the pigment in the same manner as described above.

That is, the invention of claim 6 is directed to an electrophotosensitive material comprising a photosensitive layer having at least a layer containing a binder resin and a pigment (pigment dispersion layer), wherein the layer is formed by dispersing the binder resin and the pigment in an organic solvent, drying the dispersion to remove the organic solvent to prepare a powder in which the binder resin is adsorbed on the surface of pigment particles, and dispersing the powder in a dispersion medium to prepare a coating solution, and applying and drying the coating solution.

The constitution of the electrophotosensitive material of claim 6 is preferably employed in case the pigment includes a phthalocyanine pigment having strong agglomeration properties.

Accordingly, the invention of claim 7 is directed to the electrophotosensitive material according to claim 6, wherein the pigment includes at least a phthalocyanine pigment.

The constitution of the electrophotosensitive material of claim 6 is also preferably employed in case the binder resin includes polyvinyl acetal which has weak polarity and hydrogen bonding properties as compared with conventional alcohol.

And when polyvinyl acetal is used, preferable dispersion medium includes at least one selected from the group consisting of alcohol represented by the formula (1):

(1)

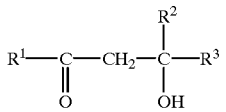

wherein $R^1$, $R^2$ and $R^3$ are the same or different and represent a hydrogen atom or an alkyl group, an alicylic ketone represented by the formula (2):

(2)

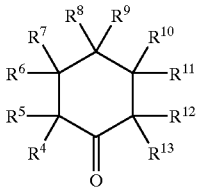

wherein $R^4$, $R^5$, $R^6$, $R^7$, $R^8$, $R^9$, $R^{10}$, $R^{11}$, $R^{12}$ and $R^{13}$ are the same or different and represent a hydrogen atom or an alkyl group, alcohol represented by the formula (3):

$$C_nH_{2n+1}OH \quad (3)$$

wherein n represents an integer of not more than 4, and a cellosolve represented by the formula (4):

$$C_mH_{2m+1}OC_2H_4OH \quad (4)$$

wherein m represents an integer of not more than 2.

Accordingly, the invention of claim 8 is directed to the electrophotosensitive material according to claim 6, wherein the binder resin includes at least polyvinyl acetal and the dispersion medium includes at least one selected from the group consisting of alcohol represented by the formula (1), an alicylic ketone represented by the formula (2), alcohol represented by the formula (3), and a cellosolve represented by the formula (4), as above mentioned.

The invention of claim 9 is directed to the electrophotosensitive material according to claim 6, wherein the existence of agglomerates of the pigment is not found in a 0.25 mm square region in actual size of the pigment dispersion layer at any of plural positions. In case the existence of at least one agglomerate of the pigment is found, the sensitivity is likely to be lowered drastically by the formation of the agglomerate of the pigment. On the other hand, the electrophotosensitive material, wherein the existence of any agglomerate of the pigment is not found in the pigment dispersion layer, is superior in sensitivity characteristics and does not cause defects such as black dots and fogging on the image.

The present inventors also have found that, in an electrophotosensitive material wherein a pigment dispersion layer is formed by using diacetone alcohol among the alcohol represented by the formula (1), a small amount of diacetone alcohol must be remained in the formed pigment dispersion layer.

Diacetone alcohol is used alone or in combination with the other dispersion medium because the dispersibility of the pigment is improved by increasing the number of the binder resin to be adsorbed onto the surface of the pigment, as described previously. Accordingly, in order to form the pigment dispersion layer while maintaining good pigment dispersibility, diacetone alcohol, which swells the binder resin, is preferably remained until the completion of the formation of the pigment dispersion layer.

To the contrary, regarding the pigment dispersion layer wherein diacetone alcohol is not remained after formation, diacetone alcohol has already evaporated at any stage of the formation process and the dispersibility of the pigment is not secured thereafter and, therefore, the agglomerate is frequently formed. On the other hand, the pigment dispersion layer wherein diacetone alcohol is remained after the formation is a layer which is free from agglomerates and is superior in dispersibility of the pigment.

Therefore, the present inventors have further studied about the method of detecting whether or not diacetone alcohol is remained in the pigment dispersion layer after formation, thus completing the present invention.

The invention of claim 10 is directed to an electrophotosensitive material comprising a photosensitive layer having at least a layer containing a binder resin and a pigment (pigment dispersion layer), wherein the layer contains diacetone alcohol, characterized in that a sample collected from the layer has peaks at a detection time ranging from 5.3 to 7.5 minutes in gas chromatography at a thermal decomposition temperature higher than a boiling point of diacetone alcohol, and that the sample has peaks at the positions where a m/z value as a ratio of a mass to an electric charge is 43, 59 and 101, in a mass spectrum detected by a specific ion detection process of at least one peak of the gas chromatographic peaks.

The constitution of the electrophotosensitive material of claim 10 is preferably employed in case the binder resin includes polyvinyl acetal and the pigment includes a phthalocyanine pigment.

Accordingly, the invention of claim 11 is directed to the electrophotosensitive material according to claim 10, wherein the binder resin includes at least polyvinyl acetal and the pigment includes at least a phthalocyanine pigment.

The invention of claim 12 is directed to a method of producing an electrophotosensitive material comprising a photosensitive layer having at least a layer containing a binder resin and a pigment (pigment dispersion layer), which comprises steps of:

dispersing the binder resin and the pigment in a dispersion medium comprising at least alcohol represented by the formula (1):

(1)

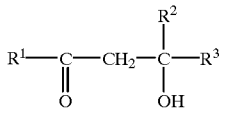

wherein $R^1$, $R^2$ and $R^3$ are the same or different and represent a hydrogen atom or an alkyl group, to prepare a coating solution; and applying and drying the coating solution to form a layer containing the binder resin and the pigment.

According to the method of claim 12, the electrophotosensitive material of claim 1 (hereinafter referred to as a "first electrophotosensive material") having excellent characteristics described above can be produced efficiently.

The invention of claim 13 is directed to a method of producing an electrophotosensitive material comprising a photosensitive layer having at least a layer containing a binder resin and a pigment (pigment dispersion layer), which comprises the steps of:

dispersing the binder resin and the pigment in an organic solvent and drying the dispersion to remove the organic solvent to prepare a powder in which the binder resin is adsorbed on the surface of pigment particles;

dispersing the powder in a dispersion medium to prepare a coating solution; and applying and drying the coating solution to form a layer containing the binder resin and the pigment.

According to the method of claim 13, the electrophotosensitive material of claim 6 (hereinafter referred to as a "second electrophotosensitive material") having excellent characteristics described above can be produced efficiently.

DETAILED DESCRIPTION OF THE INVENTION

Figure 1:
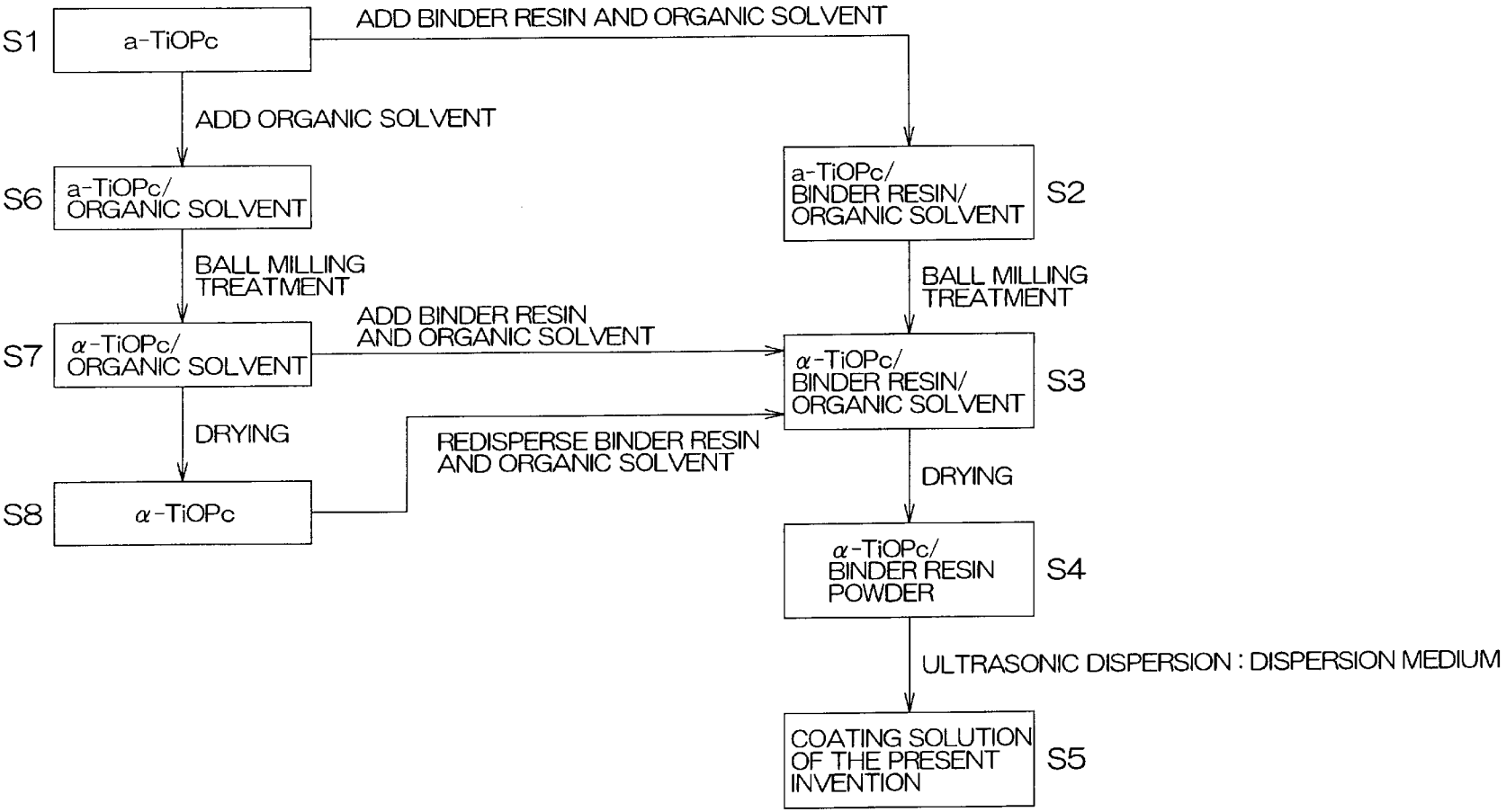
FIG. 1 is a block diagram showing an example of the steps of preparing a coating solution.

The present invention will be described below.

<Electrophotosensitive Material>

The electrophotosensitive material of the present invention comprises a single-layer or multi-layer structure photosensitive layer, which includes a pigment dispersion layer wherein a pigment as an electric charge generating material is dispersed in a binder resin.

(Pigment Dispersion Layer)

The pigment dispersion layer includes:

(I) a single-layer type photosensitive layer wherein a pigment and an electric charge transferring material (electron transferring material, hole transferring material) capable of transferring electric charges are dispersed in a binder resin; and (II) an electric charge generating layer among a multi-layer type photosensitive layer wherein an electric charge generating layer containing a pigment and an electric charge transferring layer containing an electric charge transferring material are mutually laminated.

It is preferred that, in case of taking enlarged microphotographs of the pigment dispersion layer at plural positions on said layer, the existence of agglomerates of the pigment is not found in a 0.25 mm square region in actual size.

In case the existence of at least one agglomerate of the pigment is found in the pigment dispersion layer, the sensitivity is likely to be drastically lowered by the formation of the agglomerate of the pigment. It is sometimes impossible to obtain a good electrophotosensitive material which is superior in sensitivity characteristics and does not cause defects such as black dots and fogging on the image.

Specific method of measuring agglomerates of the pigment in the pigment dispersion layer includes, for example, a method of taking a microphotograph with a predetermined magnification using an optical microscope and analyzing the microphotograph.

The measurement is performed at plural positions on the pigment dispersion layer. Because accurate results can not be obtained by the measurement only at one position. In case of a drum type photosensitive material, the coating solution is applied from one end to the other end in order. Therefore, plural positions at which the measurement is performed include both ends of the drum and one position between them (drum center) or two or more positions.

Examples of the pigment include conventionally known pigments, for example, powders of inorganic photoconductive materials such as selenium, selenium-tellurium, selenium-arsenic, cadmium sulfide, and α-silicon; organic pigments such as azo pigment, bisazo pigment, perylene pigment, anthanthrone pigment, phthalocyanine pigment, indigo pigment, triphenylmethane pigment, threne pigment, toluidine pigment, pyrrazolinepigment, quinacridone pigment, and dithioketopyrrolopyrrole pigment. However, the constitution of the present invention can be preferably applied to the phthalocyanine pigment having strong agglomeration properties as described above. Examples of the phthalocyanine pigment include x-type metal-free phthalocyanine [x-$H_2$Pc], α-type titanyl phthalocyanine [α-TiOPc], Y-type titanyl phthalocyanine [Y-TiOPc], and V-type hydroxygallium phthalocyanine [V-Ga(OH)Pc].

These pigments may be used alone, or two or more kinds of them may also be used in combination to control the wavelength range where the photosensitive material has the sensitivity.

Examples of the binder resin include thermoplastic resins such as styrene polymer, styrene-butadiene copolymer, styrene-acrylonitrile copolymer, styrene-maleic acid copolymer, acrylic polymer, styrene-acrylic copolymer, polyethylene, ethylene-vinyl acetate copolymer, chlorinated polyethylene, polyvinyl chloride, polypropylene, vinyl chloride-vinyl acetate copolymer, polyester, alkyd resin, polyamide, polyurethane, polycarbonate, polyallylate, polysulfone, diallyl phthalate resin, ketone resin, polyvinyl acetal, and polyether resin; crosslinkable thermosetting resins such as silicone resin, epoxy resin, phenol resin, urea resin, and melamine resin; and photocurable resins such as epoxy acrylate and urethane acrylate. As described above, the constitution of the present invention can be applied to polyvinyl acetal, which is liable to cause problems when using in combination with a conventional alcohol, most preferably.

Specific examples of polyvinyl acetal include polyvinyl butyral. There can also be used partially acetalized polyvinylbutyral wherein a portion of butyral in a polyvinyl butyral molecule is modified with formal or acetacetal.

These binder resins can be used alone, or two or more kinds of them may also be used in combination. Two or more polyvinyl acetals may be used in combination, and one or more polyvinyl acetals may be used in combination with other resins. In such a combination system, polyvinyl acetal is preferably used in the amount of 50% by weight or more based on the total amount of the binder resin.

(Feature of First Electrophotosensitive Material and Method of Producing the Same)

In the first electrophotosensitive material and method of producing the same, a pigment dispersion layer is formed by application and drying of a coating solution containing a binder resin and a pigment as well as alcohol represented by the formula (1):

(1)

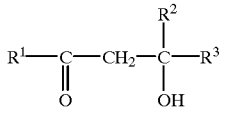

as a dispersion medium.

Specific examples of the alcohol represented by the formula (1), include diacetone alcohol (4-hydroxy-4-methyl-2-pentanone) represented by the formula (1—1):

(1-1)

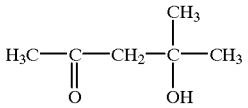

As the dispersion medium, the alcohol of the formula (1) can be used alone and other dispersion medium having the compatibility with the alcohol may be used in combination. When using in combination, it is required that the other dispersion medium does not prevent the effect of improving the dispersibility of the pigment due to the alcohol represented by the formula (1). Therefore, the alcohol represented by the formula (1) is preferably used in the amount of 50% by weight or more based on the total amount of the dispersion medium.

Examples of the other dispersion medium which can be used in combination include alcohol such as methanol, ethanol, 1-propanol, 2-propanol, and 1-butanol; cellosolves such as methylcellosolve (2-methoxyethanol) and ethylcellosolve (2-ethoxyethanol); aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cyclohexanone; esters such as ethyl acetate andmethyl acetate; and 1,4-dioxane, dimethylformaldehyde, dimethylformamide, and dimethyl sulfoxide. These other dispersion mediums can be used alone or in combination.

The coating solution may be prepared in the same manner as in the prior art. First, a pigment is added and dispersed in a dispersion medium, and a solution prepared by dissolving a binder resin in the same or different dispersion medium is then added and dispersed in the dispersion described above to form a coating solution. The coating solution may be prepared by the other conventionally known procedure.

The concentration of the coating solution may be appropriately controlled according to the coating method of the coating solution, and the composition and thickness of the pigment dispersion layer to be formed.

The coating solution contains, as the dispersion medium, alcohol represented by the formula (1) described above wherein the polarity and hydrogen bonding properties are inhibited as compared with a conventional alcohol. Therefore, it is made possible to adsorb a larger amount of the binder resin on the surface of pigment particles, thereby to improve the dispersibility of the pigment and to improve the dispersion stability of the coating solution.

Therefore, the coating solution has good dispersibility of the pigment immediately after preparation. When using the coating solution immediately after preparation, it is made possible to form an electrophotosensitive material comprising a good pigment dispersion layer wherein any agglomerate of the pigment is not observed.

The coating solution is less likely to cause separation, precipitation or the like even when stored with standing for a period of time ranging from about several days to two months immediately after preparation. If separation, precipitation or the like occurs, it is made possible to return to a good dispersion state like the state immediately after preparation when dispersed again. Therefore, it is made possible to form an electrophotosensitive material comprising a good pigment dispersion layer wherein any agglomerate of the pigment is not observed, even by using the coating solution after storage.

When a pigment having strong agglomeration properties such as α-TiOPc is used, the dispersibility of the pigment is sometimes lowered, thereby lowering the dispersion stability of the coating solution by a conventional preparation procedure even when the alcohol of the formula (1) is used as the dispersion medium. In that case, the second electrophotosensitive material and method of producing the same are preferably employed described below.

(Feature of Second Electrophotosensitive Material and Method of Producing the Same)

The second electrophotosensitive material and method of producing the same according to the present invention have a feature in the preparation procedures (A) to (C) of the coating solution used in the formation of the pigment dispersion layer.

(A) A pigment and a binder resin are dispersed in a proper organic solvent.

(B) A powder wherein the binder resin is adsorbed on the surface of pigment particles is made by drying to remove the organic solvent.

(C) The powder is dispersed in a dispersion medium to prepare a coating solution.

Thereafter, the coating solution is applied and dried to form a pigment dispersion layer.

In the preparation of the coating solution, it is not necessary to use the total amount of the binder resin in the step (A). Only a portion of the binder resin may be used in the step (A) and the remainder may be added to the coating solution, preferably in the form of a solution prepared by dissolving in a dispersion medium, in the step (C).

The amount of the binder resin used in the step (A) is preferably not less than 0.1 parts by weight based on 1 part by weight of the pigment. When the amount of the binder resin is smaller than this range, the effect of adsorbing the resin is likely to become insufficient, thereby making it impossible to improve the dispersibility of the pigment.

The organic solvent used in the step (A), any of various dispersion mediums described above can be used.

In case α-TiOPc used in the step (A) is prepared from amorphous titanyl phthalocyanine (a-TiOPc) as a raw material by subjecting to a crystallization treatment such as ball milling, the organic solvent such as dichloromethane used in the crystallization treatment can also be used in the step (A).

As shown in FIG. 1, to amorphous titanyl phthalocyanine (a-TiOPc) as the raw material (step S1), an organic solvent such as dichloromethane and a binder resin is added (step S2), followed by crystallization by means of a dispersion (ball milling) treatment using a ball mill to form a dispersion wherein α-TiOPc and the binder resin are dispersed in the organic solvent (step S3). Then, the organic solvent is removed by drying such as vacuum drying to obtain a powder in a state where a large amount of the binder resin is adsorbed on the surface of α-TiOPc particles (step S4). The powder is added to a dispersion medium, followed by a uniform dispersion treatment by means of ultrasonic dispersion to prepare a coating solution (step S5).

As shown in the same drawing, to a-TiOPc as the raw material (step S1), only an organic solvent such as dichloromethane is added (step S6), followed by a normal dispersion (ball milling) treatment (step S7) using a ball mill and further removal of the organic solvent due to drying to form α-TiOPc (step S8). Then, an organic solvent and a binder resin are added and dispersed again in this α-TiOPc to obtain a dispersion wherein α-TiOPc and the binder resin are dispersed in the organic solvent (step S3). In the same manner as described above, this dispersion is dried to remove the organic solvent, thus obtaining a powder in a state where a large amount of the binder resin is adsorbed on the surface of particles of α-TiOPc (step S4). Then, this powder is added to a dispersion medium, followed by a uniform dispersion treatment by means of ultrasonic dispersion to prepare a coating solution (step S5).

Furthermore, a binder resin and an additional organic solvent are added and dispersed in the dispersion of α-TiOPc and the organic solvent obtained in the above step S7, thus obtaining a dispersion wherein α-TiOPc (step S8) and the binder resin are dispersed in the organic solvent (step S3). Then, this dispersion is dried to remove the organic solvent, thereby obtaining a powder in a state where a large amount of the binder resin is adsorbed on the surface of particles of α-TiOPc (step S4). A coating solution is also prepared by adding this powder to a dispersion medium, followed by a uniform dispersion treatment by means of ultrasonic dispersion (step S5).

As the dispersion medium used in the coating solution, the alcohol represented by the formula (1), for example, diacetone alcohol is most preferred. However, there can also be used, for example, an alicylic ketone represented by the formula (2):

(2)

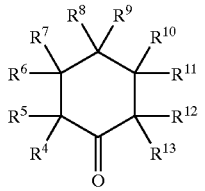

wherein $R^4$, $R^5$, $R^6$, $R^7$, $R^8$, $R^9$, $R^{10}$, $R^{11}$, $R^{12}$ and $R^{13}$ are the same or different and represent a hydrogen atom or an alkyl group, alcohol represented by the formula (3):

$$C_nH_{2n+1}OH \quad (3)$$

wherein n represents an integer of not more than 4, or a cellosolve represented by the formula (4):

$$C_mH_{2m+1}OC_2H_4OH \quad (4)$$

wherein m represents an integer of not more than 2.

Examples of the alicylic ketone represented by the formula (2) include cyclohexanone. Examples of the alcohol represented by the formula (3) include methanol, ethanol, 1-propanol, 2-propanol, 1-butanol, 2-butanol, 2-methyl-1-propanol, and 2-methyl-2-propanol. Examples of the cellosolve represented by the formula (4) include methylcellosolve and ethylcellosolve.

These dispersion mediums can be used alone or in combination. Other dispersion mediums having the compatibility with the above dispersion mediums may be used in combination. When using in combination, preferable dispersion mediums described above may be used in the amount of 50% by weight or more based on the total amount of the dispersion medium.

With the constitution described above, a powder in the state where the binder resin is adsorbed on the surface of pigment particles is previously made and then the powder is added to the dispersion medium to form a coating solution. Therefore, even when the pigment having strong agglomeration properties such as α-TiOPc is used or the dispersion medium other than the alcohol represented by the formula (1) is used, the dispersibility of the pigment is improved, thereby improving the dispersion stability of the coating solution.

Accordingly, such a coating solution also has good dispersibility of the pigment immediately after preparation. When using the coating solution immediately after preparation, it is made possible to form an electrophotosensitive material comprising a good pigment dispersion layer wherein any agglomerate of the pigment is not observed.

The coating solution is less likely to cause separation, precipitation or the like even when stored with standing for a period of time ranging from about several days to two months immediately after preparation. If separation, precipitation or the like occurs, it is made possible to return to a good dispersion state like the state immediately after preparation when dispersed again. Therefore, it is made possible to form an electrophotosensitive material comprising a good pigment dispersion layer wherein any agglomerate of the pigment is not observed, even by using the coating solution after storage.

(Feature of the Electrophotosensitive Material of claim 10)

The electrophotosensitive material of claim 10 (hereinafter referred to as a "third electrophotosensitive material") according to the present invention have a feature that diacetone alcohol is remained in a pigment dispersion layer formed by using, as a dispersion medium, diacetone alcohol among the alcohol represented by the formula (1).

That is, they have a feature that a sample collected from the above pigment dispersion layer has peaks at a detection time ranging from 5.3 to 7.5 minutes in gas chromatography at a thermal decomposition temperature higher than a boiling point of diacetone alcohol and also has peaks at the positions where a m/z value as a ratio of a mass to an electric charge is 43, 59 and 101, in a mass spectrum detected by a specific ion detection process of at least one peak of the gas chromatographic peaks.

The reason is as described above.

The procedure for preparation of the coating solution and the method of forming the pigment dispersion layer are the same as those in case of the first and second electrophotosensitive materials. As the other dispersion medium used in combination with diacetone alcohol, for example, any of various dispersion mediums described above can be used.

The thermal decomposition temperature may be higher than 166° C. , which is a boiling point of diacetone alcohol, and preferably about 170° C.

(Single-Layer Type Photosensitive Layer)

In case the pigment dispersion layer of the first to third electrophotosensitive materials is a single-layer type photosensitive layer (I), the single-layer type photosensitive layer is formed by applying a coating solution for single-layer type photosensitive layer, which is prepared by further adding an electric charge transferring material to a coating solution, in addition to the respective components described above, on a conductive substrate, followed by drying. Such a single-layer type photosensitive layer is superior in productivity because of its simple layer construction.

Timing of the addition of the electric charge transferring material to the coating solution is not specifically limited. The electric charge transferring material may be added together with the pigment at the initial point of time during the preparation of the coating solution described above, and also may be added after the completion of the step of dispersing the pigment in the dispersion medium. The electric charge transferring material may be added at arbitrary point of time during the preparation of the coating solution.

As the electric charge transferring material, an electron transferring material and/or a hole transferring material can be used. The single-layer type photosensitive layer using both electron transferring materials in combination has an advantage capable of coping with any of positive and negative charging types with a single constitution.

The electron transferring material is preferably an electron transferring material which has good matching with a pigment as the electric charge generating material, and which extracts electrons generated in the pigment and can transfer them efficiently. The hole transferring material is preferably a hole transferring material which has good matching with the pigment, and which extracts holes generated in the pigment and can transfer them efficiently.

In the system wherein the electron transferring material and the hole transferring material coexist, if the two materials form a charge transfer complex, the electric charge transferability is lowered, whereby the sensitivity of the photosensitive material is lowered. Therefore, it is necessary in this system to prevent the electron transferring material and the hole transferring material from forming a charge transfer complex. That is, it is preferred to select a combination of the both transferring materials. So that, even if both transferring materials are contained in the same layer in high concentration where hole transfer and electron transfer occur efficiently, no charge transfer complex is formed in the layer and, moreover, the hole transferring material can efficiently transfer holes, and electron transferring material can efficiently transfer electrons, respectively.

(Multi-Layer Type Photosensitive Layer)

In case the pigment dispersion layer of the first to third electrophotosensitive materials is an electric charge generating layer among the multi-layer type photosensitive layer (II), the electric charge generating layer is formed by applying a coating solution with the composition described above on a conductive substrate, followed by drying.

A coating solution containing an electric charge transferring material and a binder resin is applied on the electric charge generating layer, followed by drying to form an electric charge transferring layer, thus forming a multi-layer type photosensitive layer.

On the other hand, the electric charge generating layer may be formed after the electric charge transferring layer was previously formed on the conductive substrate.

Since the electric charge generating layer has a film thickness which is very smaller than that of the electric charge transferring layer, the electric charge generating layer preferably formed on the conductive substrate and then the electric charge transferring layer is preferably formed thereon to protect the electric charge generating layer.

The charging type (positive or negative charging type) of the multi-layer type photosensitive layer is selected according to the order of formation of the electric charge generating layer and electric charge transferring layer and the kind of the electric charge transferring material used in the electric charge transferring layer.

For example, when the electric charge generating layer is formed on the conductive substrate and the electric charge transferring layer is formed thereon, and the hole transferring material is used as the electric charge transferring material of the electric charge transferring layer, a negative charging type photosensitive layer is obtained. In this case, the electric charge generating layer may contain an electron transferring material. The electron transferring material to be incorporated into the electric charge generating layer is preferably an electron transferring material which has good matching with a pigment, and which extracts electrons generated in the pigment and can transfer them efficiently.

With the layer constitution described above, when the electron transferring material is used as the electric charge transferring material of the electric charge transferring layer, a positive charging type photosensitive layer is obtained. In this case, the electric charge generating layer may contain a hole transferring material. The hole transferring material to be incorporated into the electric charge generating layer is preferably a hole transferring material which has good matching with the pigment, and which extracts holes generated in the pigment and can transfer them efficiently.

(Electron Transferring Material)

Any of conventionally known various electron transferring compounds can be used as the electron transferring material. Particularly, there can be preferably used various electron attractive compounds, for example, benzoquinone compound, diphenoquinone compound, naphthoquinone compound, malononitrile, thiopyran compound, tetracyanoethylene, 2,4,8-trinitrothioxanthone, fluorenone compound [e.g. 2,4,7-trinitro-9-fluorenone, etc.], dinitrobenzene, dinitroanthracene, dinitroacridine, nitroanthraquinone, succinic anhydride, maleic anhydride, dibromomaleic anhydride, 2,4,7-trinitrofluorenoneimine compound, ethylated nitrofluorenoneimine compound, tryptoanthryn compound, tryproanthrynimine compound, azafluorenone compound, dinitropyridoquinazoline compound, thioxanthene compound, 2-phenyl-1,4-naphthoquinone compound, 5,12-naphthacenequinone compound, α-cyanostilbene compound, 4'-nitrostilbene compound, and salts of an anion radical of benzoquinone compound and cation. These electron transferring materials can be used alone or in combination.

Among these electron transferring materials, a diphenoquinone compound such as 3,3',5,5'-tetra-tert-butyl-4,4'-diphenoquinone and a naphthoquinone compound such as 2-benzyloxycarbonyl-3-phenyl-1,4-naphthoquinone are preferably used as the electron transferring material which has good matching with a pigment, particularly the phthalocyanine pigment, and also has good electron transferability.

(Hole Transferring Material)

Any of conventionally known various hole transferring compounds can be used as the hole transferring material. Particularly, there can be preferably used benzidine compound, phenylenediamine compound, naphthylenediamine compound, phenanthrylenediamine compound, oxadiazole compound [e.g. 2,5-di(4-methylaminophenyl)-1,3,4-oxadiazole], styryl compound [e.g. 9-(4-diethylaminostyryl)anthracene], carbazole compound [e.g. poly-N-vinylcarbazole], organopolysilane compound, pyrazoline compound [e.g. 1-phenyl-3-(p-dimethylaminophenyl)pyrazoline], hydrazone compound, triphenylamine compound, indole compound, oxazole compound, isoxazole compound, thiazole compound, thiadiazole compound, imidazole compound, pyrazole compound, triazole compound, butadiene compound, pyrene-hydazone compound, acrolein compound, carbazole-hydrazone compound, quinoline-hydrazone compound, stilbene compound, stilbene-hydrazone compound, and diphenylenediamine compound. These hole transferring materials can be used alone or in combination.

Among these hole transferring materials, a phenylenediamine compound such as N,N,N',N'-tetrakis(3-methylphenyl)-1,3-diaminobenzen e or 3,3,-dimethyl-N,N,N',N'-tetrakis(4-methylphenyl)-1,1'-biphenyl-4,4 1-diamine is preferably used as the hole transferring material which has good matching with a pigment, particularly the phthalocyanine pigment, and also has good hole transferability.

(Other Components)

As the binder resin contained in the electric charge transferring layer among the multi-layer type photosensitive layer, for example, various resins described above can be used, but are not limited thereto.

In addition to the respective components described above, various additives such as sensitizers, fluorene compounds, ultraviolet absorbers, plasticizers, surfactants, and leveling agents, can be added. To improve the sensitivity of the photosensitive material, for example, sensitizers such as terphenyl, halonaphthoquinones and acenaphthylene may be used in combination with the pigment.

In the multi-layer type photosensitive material, the pigment and binder resin, which constitute the electric charge generating layer, can be incorporated in various proportions. The pigment may be incorporated in the amount within a range from 5 to 1000 parts by weight, and preferably from 30 to 500 parts by weight, based 100 parts by weight of the binder resin.

When using two or more pigments in combination, the amount of pigments is the total amount thereof.

The electric charge transferring material and binder resin, which constitute the electric charge transferring layer, can be incorporated in various proportions as far as transfer of electric charges is not prevented and crystallization does not occur. The electric charge transferring material may be incorporated in the amount within a range from 10 to 500 parts by weight, and preferably from 25 to 200 parts by weight, based 100 parts by weight of the binder resin so that electric charges generated in the electric charge generating layer can be easily transferred.

With respect to the thickness of the multi-layer type photosensitive layer, the thickness of the electric charge generating layer is preferably within a range from about 0.01 to 5 μm, and particularly preferably from about 0.1 to 3 μm, while the thickness of the electric charge transferring layer is preferably within a range from about 2 to 100 μm, and particularly preferably from about 5 to 50 μm.

In the single-layer type photosensitive material, the pigment may be incorporated in the amount within a range from 0.1 to 50 parts by weight, and preferably from 0.5 to 30 parts by weight, based on 100 parts by weight of the binder resin. The electric charge transferring material may be incorporated in the amount within a range from 20 to 500 parts by weight, and preferably from 30 to 200 parts by weight, based on 100 parts by weight of the binder resin.

When using two or more pigments in combination, the amount of pigments is the total amount thereof.

When any of the electron transferring material and hole transferring material are used as the electric charge transferring material, the amount of the electric charge transferring material is an amount of each one transferring material. When the electron transferring material and hole transferring material are used in combination, the amount is the total amount.

When the electron transferring material and hole transferring material are used in combination, the electron transferring material is preferably incorporated in the amount within a range from 10 to 100 parts by weight based on 100 parts by weight of the hole transferring material.

The thickness of the single-layer type photosensitive layer is preferably within a range from 5 to 100 μm, and particularly preferably from about 10 to 50 μm.

A barrier layer may be formed between the conductive substrate and photosensitive layer in the photosensitive material having a single-layer type photosensitive layer, whereas, the barrier layer may be formed between the conductive substrate and electric charge generating layer, or between the conductive substrate and electric charge transferring layer, or between the electric charge generating layer and electric charge transferring layer in the photosensitive material having a multi-layer type photosensitive layer, as far as characteristics of the photosensitive material are not prevented. A surface protective layer may be formed on the surface of the photosensitive material having a single-layer type or multi-layer type photosensitive layer.

As the conductive substrate on which each layer described above is formed, for example, various materials having the conductivity can be used. The conductive substrate includes, for example, conductive substrates made of metals such as iron, aluminum, copper, tin, platinum, silver, vanadium, molybdenum, chromium, cadmium, titanium, nickel, palladium, indium,, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength.

To improve the dispersibility of the electric charge transferring material and the smoothness of the surface of the photosensitive layer, for example, surfactants and leveling agents may be added to the coating solution for each layer.

EXAMPLES

The following Examples and Comparative Examples further illustrate the present invention in detail.

Example 1

(Preparation of Coating Solution for Electric Charge Generating Layer and Formation of Electric Charge Generating Layer)

The respective components described below were used.

Pigment: Y-TiOPc

Binder resin: polyvinyl butyral [BM-1, manufactured by Sekisui Chemical Co., Ltd.]

Dispersion medium: diacetone alcohol

1 Part by weight of Y-TiOPc was added to 39 parts by weight of diacetone alcohol, followed by dispersion using an ultrasonic dispersing device to prepare a dispersion.

1 Part by weight of polyvinyl butyral was dissolved in 9 parts by weight of diacetone alcohol to prepare a solution.

40 Parts by weight of the dispersion and 10 parts by weight of the solution were mixed, followed by dispersion again using an ultrasonic dispersing device and further filtration using a quartz glass wool (wool diameter ranging from 1 to 5 $\mu$m) and a syringe to prepare a coating solution for electric charge generating layer among a multi-layer type photosensitive layer.

The composition of the coating solution was Y-TiOPc/polyvinyl butyral/diacetone alcohol=1/1/48 (weight ratio).

Immediately after preparation of this coating solution, and after standing in a closed system at normal temperature and normal pressure for a fixed period and further dispersion again using an ultrasonic dispersing device, the coating solution was applied on an aluminum tube as a conductive substrate using a Teflon blade, followed by hot-air drying at 110° C. for five minutes to form an electric charge generating layer having a film thickness of 0.5 $\mu$m. The standing period was set within a range from 1 day to 60 days immediately after the preparation of the coating solution at intervals of 1 day.

(Formation of Electric Charge Transferring Layer and Production of Electrophotosensitive Material)

0.05 Parts by weight of 3,3',5,5'-tetra-tert-butyl-4,4'-diphenoquinone, 0.8 parts by weight of N,N,N',N'-tetrakis (3-methylphenyl)-1,3-diaminobenzene, 0.95 parts by weight of Z-type polycarbonate (Panlite TS2050, manufactured by Teijin Chemicals, Ltd.), 0.05 parts by weight of a polyester resin [RV200, manufactured by Toyobo Co., Ltd.] and 8 parts by weight of tetrahydrofuran were mixed and dissolved to obtain a coating solution for electric charge transferring layer. This solution was applied on the electric charge generating layer described above using a Teflon blade, followed by hot-air drying at 110° C. for 30 minutes to form an electric charge transferring layer having a film thickness of 30 $\mu$m, thus producing an electrophotosensitive material having a multi-layer type photosensitive layer.

Examples 2–6

In the same manner as in Example 1, except that the respective components described below were used, a coating solution for electric charge generating layer was prepared. The amount of the respective components was the same as in Example 1. In the same manner as in Example 1, except that an electric charge generating layer was formed by using this coating solution, electrophotosensitive materials having a multi-layer type photosensitive layer were produced.

Example 2

Pigment: Y-TiOPc

Binder resin: polyvinyl butyral [BM-S, manufactured by Sekisui Chemical Co., Ltd.]

Dispersion medium: diacetone alcohol

Example 3

Pigment: Y-TiOPc

Binder resin: partially acetalized polyvinyl butyral [BX-1, manufactured by Sekisui Chemical Co., Ltd.]

Dispersion medium: diacetone alcohol

Example 4

Pigment: Y-TiOPc

Binder resin: polyvinyl butyral [DENKA BUTYRAL #3000-K, manufactured by Denki Kagaku Kogyo Kabushiki Kaisha]

Dispersion medium: diacetone alcohol

Example 5

Pigment: α-TiOPc

Binder resin: polyvinyl butyral [BM-1, manufactured by Sekisui Chemical Co., Ltd.]

Dispersion medium: diacetone alcohol

Example 6

Pigment: α-TiOPc

Binder resin: partially acetalized polyvinyl butyral [BX-1, manufactured by Sekisui Chemical Co., Ltd.]

Dispersion medium: diacetone alcohol

Comparative Examples 1–3

In the same manner as in Example 1, except that the respective components described below were used, a coating solution for electric charge generating layer was prepared. The amount of the respective components was the same as in Example 1. In the same manner as in Example 1, except that an electric charge generating layer was formed by using this coating solution, electrophotosensitive materials having a multi-layer type photosensitive layer were produced.

Comparative Example 1

Pigment: α-TiOPc

Binder resin: polyvinyl butyral [BM-1, manufactured by Sekisui Chemical Co., Ltd.)]

Dispersion medium: 1-butanol

Comparative Example 2

Pigment: α-TiOPc

Binder resin: polyvinyl butyral [BM-S, manufactured by Sekisui Chemical Co., Ltd.]

Dispersion medium: 1-propanol

Comparative Example 3

Pigment: α-TiOPc

Binder resin: polyvinyl butyral [BM-S, manufactured by Sekisui Chemical Co., Ltd.]

Dispersion medium: 2-propanol

<Evaluation of Dispersion State of Coating Solution>

Dispersion of the pigment was evaluated by observing the coating solutions for electric charge generating layer used in the respective Examples and Comparative Examples immediately after preparation according to the following criteria.

Good: Any of microdispersion due to agglomeration of pigment particles, precipitation of a solid matter and separation of a liquid was not observed. Even if microdispersion, precipitation and separation are observed, these phenomena disappeared completely when dispersed again using an ultrasonic dispersing device, good dispersibility.

Bad: Microdispersion, precipitation and separation were observed and these phenomena did not disappear completely when dispersed again using an ultrasonic dispersing device, poor dispersibility.

The coating solution was allowed to stand in a closed system at normal temperature and normal humidity until 60 days have passed since the completion of the preparation. During standing, the coating solution was observed in the same manner at the same time as that of the beginning of the standing every day. Standing days, during which the dispersibility evaluated by the criteria described above could maintain "Good", were recorded.

The results are shown in Table 1. In the table, abbreviations in the column of the dispersion medium are as follows.

DAA: diacetone alcohol
1-BuOH: 1-butanol
1-PrOH: 1-propanol
2-PrOH: 2-propanol

TABLE 1

| | Pigment | Binder resin | Dispersion medium | Dispersibility of coating solution: Immediately after preparation | Dispersibility of coating solution: Standing days during which dispersibility maintained "Good" |
|---|---|---|---|---|---|
| Example 1 | Y-TiOPc | BM-1 | DAA | Good | 60 days |
| Example 2 | Y-TiOPc | BM-S | DAA | Good | 60 days |
| Example 3 | Y-TiOPc | BX-1 | DAA | Good | 60 days |
| Example 4 | Y-TiOPc | 3000K | DAA | Good | 60 days |
| Example 5 | α-TiOPc | BM-1 | DAA | Good | 13 days |
| Example 6 | α-TiOPc | BX-1 | DAA | Good | 13 days |
| Comp. Example 1 | α-TiOPc | BM-1 | 1-BuOH | Bad | — |
| Comp. Example 2 | α-TiOPc | BM-S | 1-PrOH | Bad | — |
| Comp. Example 3 | α-TiOPc | BM-S | 2-PrOH | Bad | — |

It was confirmed from the table 1 that any of coating solutions using conventional alcohols of the respective Comparative Examples exhibits poor dispersibility by the time immediately after preparation.

To the contrary, any of coating solutions using diacetone alcohol of the respective Examples exhibited good dispersibility at the time immediately after preparation.

It was confirmed that any of coating solutions using Y-TiOPc of the respective Examples maintains good dispersibility during standing for 60 days. It was also confirmed that both coating solutions using α-TiOPc, which has agglomeration properties stronger than those of Y-TiOPc, of Examples 5 and 6 maintain good dispersibility during standing for 13 days.

<Observation of Electric Charge Generating Layer>

The coating solutions immediately after preparation of the respective Examples and Comparative Examples were applied on a glass substrate to give samples. Using an optical microscope, microphotographs with magnification of 455 times were taken at five positions (four corners and center) of the substrate, and then it was examined whether or not agglomerates of the pigment are observed in a 0.25 mm square region in actual size.

The coating solution was allowed to stand in a closed system at normal temperature and normal humidity until 60 days have passed since the completion of the preparation. During standing, the coating solution was taken out at the same time as that of the beginning of the standing every day. In case microdispersion due to agglomeration of pigment particles, precipitation of a solid matter and separation of a liquid were observed, samples were obtained by applying the coating solution on the glass substrate, as it is, in the same manner as described above. In case microdispersion, precipitation and separation were observed, samples were obtained by applying the coating solution on the glass substrate after dispersing again by using an ultrasonic dispersing device. Using an optical microscope, the same examination was performed and the number of standing days, during which no agglomerate was formed, was recorded.

The results are shown in Table 2.

TABLE 2

| | Formation of agglomerates of pigment in electric charge generating layer: Immediately after preparation | Formation of agglomerates of pigment in electric charge generating layer: Number of standing days during which no agglomerate was formed |
|---|---|---|
| Example 1 | None | 60 days |
| Example 2 | None | 60 days |
| Example 3 | None | 60 days |
| Example 4 | None | 60 days |
| Example 5 | None | 13 days |
| Example 6 | None | 13 days |
| Comp. Example 1 | Formed | — |
| Comp. Example 2 | Formed | — |
| Comp. Example 3 | Formed | — |

It was confirmed from the table 2 that an agglomerate was formed in the electric charge generating layer when using the coating solutions of the respective Comparative Examples even if the coating solutions are those immediately after prepared.

To the contrary, no agglomerate was formed in the electric charge generating layer when using the coating solutions of Examples 1 to 4 even if the coating solutions are those allowed to stand for 60 days, not to mention those immediately after preparation.

It was confirmed that no agglomerate was formed in the electric charge generating layer when using the coating solutions of Examples 5 and 6 even if the coating solutions are those allowed to stand for 13 days.

<Analysis of Electric Charge Generating Layer>

Samples obtained by removing the electric charge generating layer from the electrophotosensitive material of Example 1 were thermally decomposed at 170° C. to evolve a gas, which was then analyzed by using a gas chromatograph-mass spectrometer (GC-MS).

Since a very trace amount of the desired diacetone alcohol is detected in this case, only a component having peaks of mass spectrum at the positions where a ratio of a mass to an electric charge (M/Z) is 43, 59 and 101, which is specific to diacetone alcohol, was selected and detected.

Figure 2:
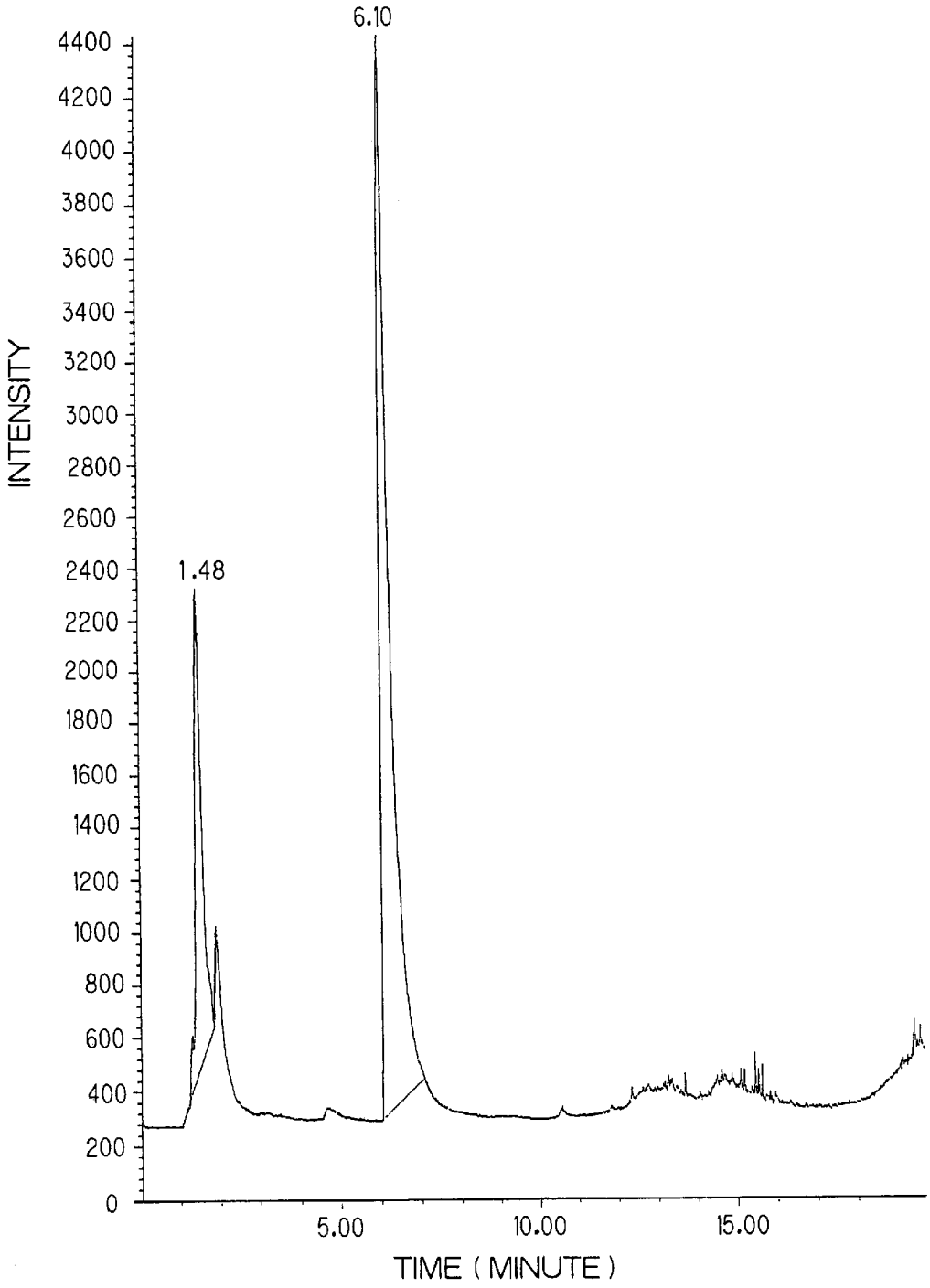
FIG. 2 is a graph showing a chart of gas chromatograph of a sample collected from the electric charge generating layer of the electrophotosensitive material of Example 1.
Figure 3:
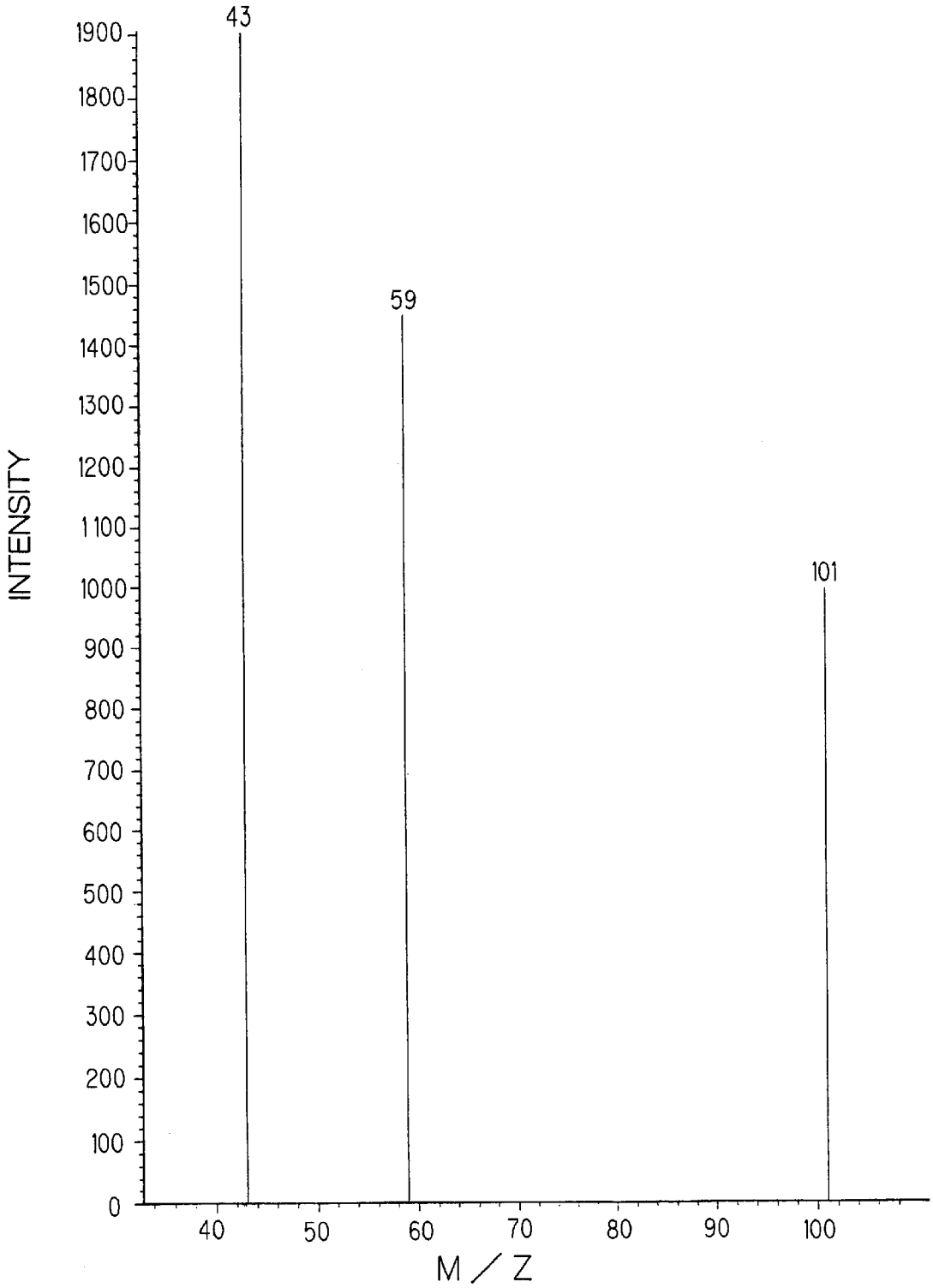
FIG. 3 is a graph showing a chart of mass spectrum obtained by analyzing components of peaks generated at 6.10 minutes of the chart shown in FIG. 2

As shown in FIG. 2, mass spectrum of components of peaks, which appeared at 6.10 minutes in a chart of a gas chromatograph, was analyzed. As a result, peaks of mass spectrum appeared at the positions where a ratio of a mass to an electric charge (M/Z) is 43, 59 and 101, as shown in FIG. 3.

It was confirmed from the fact that diacetone alcohol is remained in the electric charge generating layer of the electrophotosensitive material of Example 1 even after formation.

The conditions of the analysis are as follows.

(Column)

Used column: melt silica capillary column (0 .25 crosslinked phenylmethylsiloxane)

Column flow rate: 0.7 ml/min.

Injection temperature: 150° C.

Detector temperature: 280° C.

(Heating Conditions)

Initial temperature: 40° C. (10 min.)

Heating rate: 30° C./min.

Final temperature: 300° C. (1 min.)

(Thermal Decomposition Conditions)

Needle temperature: 150° C.

Oven temperature: 150° C.

Thermal decomposition time: 5 sec

Thermal decomposition temperature: 170° C.

<Sensitivity Characteristics Test of Electrophotosensitive Material>

With respect to those using the coating solution immediately after preparation among the electrophotosensitive materials of the respective Examples and Comparative Examples, a dark potential $V_H$/V and a light potential $V_L$/V were measured by the following method. Among the respective Examples, the dark potential $V_H$/V and the light potential $V_L$/V were measured with respect to those using the coating solution allowed to stand for the longest days where no agglomerate was not observed by the observation of the electric charge generating layer.

(Method of Measuring Dark Potential $V_H$/V and Light Potential $V_L$/V)

After setting the electrophotosensitive material to an inner unit of a laser beam printer [LBP-450, manufactured by Canon, Inc.], ten black and white band-shaped images were continuously printed. After printing ten images, a printer was stopped and a surface potential of the white band portion of the photosensitive material was measured as a dark potential $V_H$/V, while asurface potential of the black band portion was measured as a light potential $V_L$/V.

The results are shown in Table 3.

TABLE 3

| | State of coating solution | | | | |
|---|---|---|---|---|---|
| | Immediately after preparation | | After standing | | |
| | $V_H$/V | $V_L$/V | $V_H$/V | $V_L$/V | Standing days |
| Example 1 | 640 | 105 | 642 | 106 | 60 |
| Example 2 | 640 | 100 | 641 | 103 | 60 |
| Example 3 | 630 | 85 | 638 | 85 | 60 |
| Example 4 | 638 | 95 | 640 | 94 | 60 |
| Example 5 | 648 | 121 | 650 | 127 | 13 |
| Example 6 | 637 | 92 | 637 | 97 | 13 |
| Comp. Example 1 | 625 | 139 | — | — | — |
| Comp. Example 2 | 640 | 125 | — | — | — |
| Comp. Example 3 | 636 | 120 | — | — | — |

It was confirmed from the table 3 that the electrophotosensitive materials using any of the coating solution immediately after preparation and the coating solution allowed to stand for the longest days of the respective Examples have good sensitivity characteristics as compared with the Comparative Examples.

Example 7

(Preparation of Coating Solution for Electric Charge Generating Layer and Formation of Electric Charge Generating Layer)

The respective components described below were used.

Pigment: α-TiOPc

Binder resin: polyvinyl butyral [BM-1, manufactured by Sekisui Chemical Co., Ltd.]

Dispersion medium: diacetone alcohol

A dispersion prepared by dissolving 0.5 parts by weight of polyvinyl butyral in 19.5 parts by weight of dichloromethane, 0.5 parts by weight of a-TiOPc as a raw material of α-TiOPc and 50 parts by weight of zirconia beads were subjected to a ball moiling treatment for 24 hours using a ball mill. This dispersion was spread in a petri dish and vacuum-dried for 12 hours to remove dichloromethane, thus obtaining a powder wherein a large amount of polyvinyl butyral is absorbed on the surface of crystallized α-TiOPc particles.

Then, 0.3 parts by weight of this powder and 72.7 parts by weight of diacetone alcohol were repeatedly subjected to a dispersion treatment several times using an ultrasonic dispersing device until an agglomerate of the pigment is hardly remained on the side and bottom of a container. The solution was filtered by using a quartz glass wool (wool diameter ranging from 1 to 5 μm) and a syringe to prepare a coating solution for electric charge generating layer among a multi-layer type photosensitive layer.

In case of repeating the dispersion treatment, the subsequent dispersion treatment was performed until the solution was cooled every time the previous treatment was completed. The composition of the coating solution was α-TiOPc/polyvinyl butyral/diacetone alcohol=1/1/48 (weight ratio).

Immediately after preparation of this coating solution, and after standing in a closed system at normal temperature and normal pressure for a fixed period and further dispersion again using an ultrasonic dispersing device, the coating solution was applied on an aluminum tube as a conductive substrate using a Teflon blade, followed by hot-air drying at 110° C. for five minutes to form an electric charge generating layer having a film thickness of 0.5 /μm. The standing period was set within a range from 1 day to 60 days immediately after the preparation of the coating solution at intervals of 1 day.

(Formation of Electric Charge Transferring Layer and Production of Electrophotosensitive Material)

Using the same coating solution for electric charge transferring layer as that used in Example 1, an electric charge transferring layer having a film thickness of 20 μm was formed on the electric charge generating layer described above to produce an electrophotosensitive material having a multi-layer type photosensitive layer.

Examples 8–12

In the same manner as in Example 7, except that the respective components described below were used, a coating solution for electric charge generating layer was prepared. The amount of the respective components was the same as in Example 7. In the same manner as in Example 7, except that an electric charge generating layer was formed by using this coating solution, electrophotosensitive materials having a multi-layer type photosensitive layer were produced.

Example 8

Pigment: α-TiOPc
Binder resin: partially acetalized polyvinyl butyral [BX-1, manufactured by Sekisui Chemical Co., Ltd.]
Dispersion medium: diacetone alcohol Example 9

Pigment: α-TiOPc
Binder resin: polyvinyl butyral [BM-1, manufactured by Sekisui Chemical Co., Ltd.]
Dispersion medium: 1-butanol Example 10

Pigment: α-TiOPc
Binder resin: polyvinyl butyral [BM-1, manufactured by Sekisui Chemical Co., Ltd.]
Dispersion medium: ethylcellosolve Example 11

Pigment: α-TiOPc
Binder resin: partially acetalized polyvinyl butyral [BX-1, manufactured by Sekisui Chemical Co., Ltd.]
Dispersion medium: 1-propanol Example 12

Pigment: α-TiOPc
Binder resin: polyvinyl butyral [BM-S, manufactured by Sekisui Chemical Co., Ltd.]
Dispersion medium: 2-propanol Example 13

(Preparation of Coating Solution for Electric Charge Generating Layer and Formation of Electric Charge Generating Layer)

The respective components described below were used.

Pigment: α-TiOPc

Binder resin: polyvinyl butyral [BM-1, manufactured by Sekisui Chemical Co., Ltd.]

Dispersion medium: diacetone alcohol 0.5 parts by weight of a-TiOPc as a raw material of α-TiOPc, 19.5 parts by weight of dichloroethane and 50 parts by weight of zirconia beads were subjected to a ball milling treatment for five hours using a ball mill. This dispersion was spread in a petri dish and vacuum-dried for 12 hours to remove dichloromethane, thus obtaining a crystallized α-TiOPc powder.

Then, 0.45 parts by weight of this powder and a dispersion prepared by dissolving 0.45 parts by weight of polyvinyl butyral in 17.55 parts by weight of dichloromethane were repeatedly subjected to a dispersion treatment about several times using an ultrasonic dispersing device until completion of the dispersion of the pigment is confirmed.

This dispersion was spread again in a petri dish and vacuum-dried for 12 hours to remove dichloromethane, thus obtaining a powder wherein a large amount of polyvinyl butyral is adsorbed on the surface of α-TiOPc particles.

Then, 0.3 parts by weight of this powder and 7.2 parts by weight of diacetone alcohol were repeatedly subjected to a dispersion treatment several times using an ultrasonic dispersing device until an agglomerate of the pigment is hardly remained on the side and bottom of a container. The solution was filtered by using a quartz glass wool (wool diameter ranging from 1 to 5 μm) and a syringe to prepare a coating solution for electric charge generating layer among a multi-layer type photosensitive layer.

In case of repeating the dispersion treatment, the subsequent dispersion treatment was performed until the solution was cooled every time the previous treatment was completed. The composition of the coating solution was α-TiOPc/polyvinyl butyral/diacetone alcohol=1/1/48 (weight ratio).

Immediately after preparation of this coating solution, and after standing in a closed system at normal temperature and normal pressure for a fixed period and further dispersion again using an ultrasonic dispersing device, the coating solution was applied on an aluminum tube as a conductive substrate using a Teflon blade, followed by hot-air drying at 110° C. for five minutes to form an electric charge generating layer having a film thickness of 0.5 /μm. The standing period was set within a range from 1 day to 60 days immediately after the preparation of the coating solution at intervals of 1 day.

(Formation of Electric Charge Transferring Layer and Production of Electrophotosensitive Material)

Using the same coating solution for electric charge transferring layer as that used in Example 1, an electric charge transferring layer having a film thickness of 20 μm was formed on the electric charge generating layer described above to produce an electrophotosensitive material having a multi-layer type photosensitive layer.

Example 14

The respective components described below were used.

Pigment: V-Ga(OH)Pc

Binder resin: polyvinyl butyral [BM-1, manufactured by Sekisui Chemical Co., Ltd.]

Dispersion medium: cyclohexanone

A dispersion prepared by dissolving 0.5 parts by weight of polyvinyl butyral in 19.5 parts by weight of dichloroethane, 0.5 parts by weight of V-Ga(OH)Pc and 50 parts by weight of zirconia beads were subjected to a ball milling treatment for 24 hours using a ball mill. This dispersion was spread in a petri dish and vacuum-dried for 12 hours to remove dichloromethane, thus obtaining a powder wherein a large amount of polyvinyl butyral is adsorbed on the surface of V-Ga(OH)Pc particles.

Then, 0.3 parts by weight of this powder and 7.2 parts by weight of cyclohexanone were repeatedly subjected to a dispersion treatment several times using an ultrasonic dispersing device until an agglomerate of the pigment is hardly remained on the side and bottom of a container. The solution was filtered by using a quartz glass wool (wool diameter ranging from 1 to 5 μm) and a syringe to prepare a coating solution for electric charge generating layer among a multi-layer type photosensitive layer.

In case of repeating the dispersion treatment, the subsequent dispersion treatment was performed until the solution was cooled every time the previous treatment was completed. The composition of the coating solution was V-Ga(OH)Pc/polyvinylbutyral/cyclohexanone=1/1/48 (weight ratio).

Immediately after preparation of this coating solution, and after standing in a closed system at normal temperature and normal pressure for a fixed period and further dispersion again using an ultrasonic dispersing device, the coating solution was applied on an aluminum tube as a conductive substrate using a Teflon blade, followed by hot-air drying at 110° C. for five minutes to form an electric charge generating layer having a film thickness of 0.5 μm. The standing period was set within a range from 1 day to 60 days immediately after the preparation of the coating solution at intervals of 1 day.

(Formation of Electric Charge Transferring Material and Production of Electrophotosensitive Material)

Using the same coating solution for electric charge transferring layer as that used in Example 1, an electric charge transferring layer having a film thickness of 20 μm was formed on the electric charge generating layer described above to produce an electrophotosensitive material having a multi-layer type photosensitive layer.

Comparative Example 4

In the same manner as in Example 1, except that the respective components described below were used, a coating solution for electric charge generating layer was prepared. The amount of the respective components was the same as in Example 1. In the same manner as in Example 1, except that an electric charge generating layer was formed by using this coating solution, electrophotosensitive materials having a multi-layer type photosensitive layer were produced.

Pigment: V-Ga(OH)Pc

Binder resin: polyvinyl butyral [BM-1, manufactured by Sekisui Chemical Co., Ltd.]

Dispersion medium: cyclohexanone

With respect to the coating solutions for electric charge generating layer used in the respective Examples and Comparative Example, the above-described evaluation test of the dispersion state of the coating solution was performed. The results are shown in Table 4. In the table, abbreviations in the column of the dispersion medium are as follows.

DAA: diacetone alcohol
1-BuOH: 1-butanol
1-PrOH: 1-propanol
2-PrOH: 2-propanol
E-Cell: ethylcellosolve
C-Hex: cyclohexanone

TABLE 4

| | Pigment | Binder resin | Dispersion medium | Dispersibility of coating solution: Immediately after preparation | Dispersibility of coating solution: Standing days during which dispersibility maintained "Good" |
|---|---|---|---|---|---|
| Example 7 | α-TiOPc | BM-1 | DAA | Good | 60 days |
| Example 8 | α-TiOPc | BX-1 | DAA | Good | 60 days |
| Example 9 | α-TiOPc | BM-1 | 1-BuOH | Good | 60 days |
| Example 10 | α-TiOPc | BM-1 | E-Cell | Good | 60 days |
| Example 11 | α-TiOPc | BX-1 | 1-PrOH | Good | 60 days |
| Example 12 | α-TiOPc | BM-S | 2-PrOH | Good | 60 days |
| Example 13 | α-TiOPc | BM-1 | DAA | Good | 60 days |
| Example 14 | V-Ga(OH)Pc | BM-1 | C-Hex | Good | 60 days |
| Comp. Example 4 | V-Ga(OH)Pc | BM-1 | C-Hex | Bad | — |

It was confirmed from the table 4 that any of coating solutions immediately after preparation of the respective Examples exhibited good dispersibility, and maintains good dispersibility during standing for 60 days, though α-TiOPc having strong agglomeration properties or V-Ga(OH)Pc having agglomeration properties stronger than α-TiOPc is used.

With respect to the coating solutions for electric charge generating layer used in the respective Examples and Comparative Example, the above-described observation of electric charge generating layer was performed. The results are shown in Table 5.

TABLE 5

| | Formation of agglomerates of pigment in electric charge generating layer: Immediately after preparation | Number of standing days during which no agglomerate was formed |
|---|---|---|
| Example 7 | None | 60 days |
| Example 8 | None | 60 days |
| Example 9 | None | 60 days |
| Example 10 | None | 60 days |
| Example 11 | None | 60 days |
| Example 12 | None | 60 days |
| Example 13 | None | 60 days |
| Example 14 | None | 60 days |
| Comp. Example 1 | Formed | — |

It was confirmed from the table 5 no agglomerate was formed in the electric charge generating layer when the coating solutions of the respective Examples are used even if the coating solutions are those allowed to stand for 60 days, not to mention those immediately after preparation.

With respect to the electrophotosensitive materials produced in the respective Examples and Comparative Example, the above-described sensitivity characteristics test was performed. The results are shown in Table 6.

TABLE 6

| | State of coating solution: Immediately after preparation | | After standing | | |
|---|---|---|---|---|---|
| | $V_H/V$ | $V_L/V$ | $V_H/V$ | $V_L/V$ | Standing days |
| Example 7 | 643 | 135 | 645 | 134 | 60 |
| Example 8 | 641 | 105 | 640 | 103 | 60 |
| Example 9 | 643 | 137 | 648 | 137 | 60 |
| Example 10 | 645 | 138 | 645 | 141 | 60 |
| Example 11 | 635 | 95 | 639 | 96 | 60 |
| Example 12 | 640 | 110 | 636 | 109 | 60 |
| Example 13 | 645 | 136 | 651 | 136 | 60 |
| Example 14 | 649 | 113 | 650 | 120 | 60 |
| Comp. Example 1 | 649 | 150 | — | — | — |

It was confirmed from the table 6 that the electrophotosensitive materials using any of the coating solution immediately after preparation and the coating solution allowed to stand for the longest days of the respective Examples have good sensitivity characteristics.

The disclosure of Japanese Patent Application No.2000-108498, filed on Apr. 10, 2000, is incorporated herein by reference.

What is claimed is:

1. An electrophotosensitive material comprising a photosensitive layer having at least a layer containing a binder resin and a pigment, wherein the layer is formed by dispersing a polyvinyl acetal as the binder resin and a phthalocyanine pigment as the pigment in an alcohol represented by the formula (1):

(1)

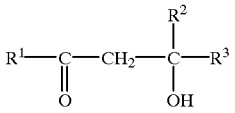

wherein $R^1$, $R^2$ and $R^3$ are the same or different and represent a hydrogen atom or an alkyl group, as a dispersion medium to prepare a coating solution, and applying and drying the coating solution.

2. The electrophotosensitive material according to claim 1, wherein the alcohol of the formula (1) is diacetone alcohol.

3. The electrophotosensitive material according to claim 1, wherein the existence of agglomerates of the pigment is not found in a 0.25 mm square region in actual size of the layer containing the binder resin and the pigment at any of plural positions.

4. An electrophotosensitive material comprising a photosensitive layer having at least a layer containing a binder resin and a pigment, wherein the layer is formed by dispersing the binder resin and the pigment in an organic solvent, drying the dispersion to remove the organic solvent to prepare a powder in which the binder resin is adsorbed on the surface of pigment particles, and dispersing the powder in a dispersion medium to prepare a coating solution, and applying and drying the coating solution.

5. The electrophotosensitive material according to claim 4, wherein the pigment includes at least a phthalocyanine pigment.

6. The electrophotosensitive material according to claim 4, wherein the binder resin includes at least polyvinyl acetal and the dispersion medium includes at least one selected from the group consisting of alcohol represented by the formula (1):

(1)

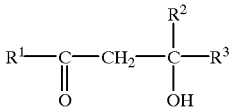

wherein $R^1$, $R^2$ and $R^3$ are the same or different and represent a hydrogen atom or an alkyl group, an alicylic ketone represented by the formula (2):

(2)

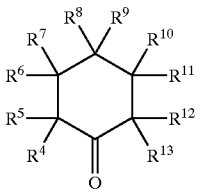

wherein $R^4$, $R^5$, $R^6$, $R^7$, $R^8$, $R^9$, $R^{10}$, $R^{11}$, $R^{12}$ and $R^{13}$ are the same or different and represent a hydrogen atom or an alkyl group, alcohol represented by the formula (3):

$$C_nH_{2n+1}OH \quad (3)$$

wherein n represents an integer of not more than 4, and a cellosolve represented by the formula (4):

$$C_mH_{2m+1}OC_2H_4OH \quad (4)$$

wherein m represents an integer of not more than 2.

7. The electrophotosensitive material according to claim 4, wherein the existence of agglomerates of the pigment is not found in a 0.25 mm square region in actual size of the layer containing the binder resin and the pigment at any of plural positions.

8. An electrophotosensitive material comprising a photosensitive layer having at least a layer containing a binder resin and a pigment, wherein the layer contains diacetone alcohol, characterized in that a sample collected from the layer has peaks at a detection time ranging from 5.3 to 7.5 minutes in gas chromatography at a thermal decomposition temperature higher than a boiling point of diacetone alcohol, and that the sample has peaks at the positions where a m/z value as a ratio of a mass to an electric charge is 43, 59 and 101, in a mass spectrum detected by a specific ion detection process of at least one peak of the gas chromatographic peaks.

9. The electrophotosensitive material according to claim 8, wherein the binder resin includes at least polyvinyl acetal and the pigment includes at least a phthalocyanine pigment.

10. A method of producing an electrophotosensitive material comprising a photosensitive layer having at least a layer containing a binder resin and a pigment, which comprises steps of:

dispersing a polyvinyl acetal as the binder resin and a phthalocyanine pigment as the pigment in an alcohol represented by the formula (1):

(1)

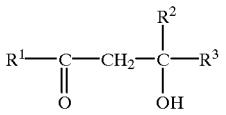

wherein $R^1$, $R^2$ and $R^3$ are the same or different and represent a hydrogen atom or an alkyl group, as a dispersion medium to prepare a coating solution; and applying and drying the coating solution to form a layer containing the binder resin and the pigment.

11. A method of producing an electrophotosensitive material comprising a photosensitive layer having at least a layer containing a binder resin and a pigment, which comprises steps of:

dispersing the binder resin and the pigment in an organic solvent, and drying the dispersion to remove the organic solvent to prepare a powder in which the binder resin is adsorbed on the surface of pigment particles;

dispersing the powder in a dispersion medium to prepare a coating solution; and applying and drying the coating solution to form a layer containing the binder resin and the pigment.

* * * * *